US009109555B2

(12) United States Patent
Yamaguchi

(10) Patent No.: US 9,109,555 B2
(45) Date of Patent: Aug. 18, 2015

(54) STRUCTURE FOR JOINING VALVE CASING TO MANIFOLD BODY OF INTAKE MANIFOLD

(71) Applicant: TOYOTA BOSHOKU KABUSHIKI KAISHA, Aichi-ken (JP)

(72) Inventor: Takuma Yamaguchi, Nagoya (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 14/275,998

(22) Filed: May 13, 2014

(65) Prior Publication Data

US 2014/0338627 A1 Nov. 20, 2014

(30) Foreign Application Priority Data

May 15, 2013 (JP) ..... 2013-103258

(51) Int. Cl.
*F02M 35/10* (2006.01)
*F02M 35/104* (2006.01)
*F02D 9/10* (2006.01)

(52) U.S. Cl.
CPC ..... *F02M 35/104* (2013.01); *F02D 9/1035* (2013.01); *F02M 35/10085* (2013.01); *F02M 35/10209* (2013.01)

(58) Field of Classification Search
CPC ..... F02M 35/104; F02M 35/10209; F02M 35/10006; F02M 35/10085; F02M 35/10091; F02M 35/10255; F02M 35/10314; F02M 35/10321; F02M 35/1034; F02M 35/1036; F02M 35/10354; F02D 9/1035
USPC ..... 123/184.21, 184.47, 336, 337, 432, 123/188.14, 184.61; 29/888.4, 890.052
See application file for complete search history.

(56) References Cited

U.S. PATENT DOCUMENTS

| | | | | |
|---|---|---|---|---|
| 5,715,782 | A * | 2/1998 | Elder | 123/184.61 |
| 6,694,940 | B2 * | 2/2004 | Kawai | 123/184.21 |
| 6,761,140 | B2 * | 7/2004 | Herold et al. | 123/188.14 |
| 6,915,774 | B2 * | 7/2005 | Sakai | 123/184.52 |
| 6,979,130 | B1 * | 12/2005 | Stangier et al. | 384/416 |
| 7,121,246 | B2 | 10/2006 | Uchiyama | |
| 8,025,042 | B2 * | 9/2011 | Kamiya | 123/336 |
| 8,091,526 | B2 * | 1/2012 | Tanikawa et al. | 123/184.21 |
| 8,118,007 | B2 * | 2/2012 | Sano | 123/306 |
| 8,555,847 | B2 * | 10/2013 | Menin et al. | 123/184.61 |
| 8,640,667 | B2 * | 2/2014 | Hisada et al. | 123/184.21 |
| 2005/0034702 | A1 | 2/2005 | Uchiyama | |

FOREIGN PATENT DOCUMENTS

| | | |
|---|---|---|
| JP | 11-141424 | 5/1999 |
| JP | 2005-61231 | 3/2005 |

* cited by examiner

*Primary Examiner* — Lindsay Low
*Assistant Examiner* — Grant Moubry
(74) *Attorney, Agent, or Firm* — Greenblum & Bernstein, P.L.C.

(57) ABSTRACT

A valve casing of a flow regulating valve is welded to an end of a downstream section of a manifold body. Two passages are formed in the valve casing of the flow regulating valve. The valve casing accommodates a valve plate for switching at least one of the passages selectively between an open state and a closed state. A joint portion between the manifold body and the valve casing has height difference such that the portion in the vicinity of the passage corresponding to the valve plate is located at a position higher than the portion in the vicinity of the other one of the passages.

5 Claims, 4 Drawing Sheets

STRUCTURE FOR JOINING VALVE CASING TO MANIFOLD BODY OF INTAKE MANIFOLD

BACKGROUND OF THE INVENTION

The present invention relates to an intake manifold, which is a component of an intake system of an automobile engine.

A conventional intake manifold of this type is disclosed in, for example, Japanese Laid-Open Patent Publications No. 11-141424 and No. 2005-61231.

Japanese Laid-Open Patent Publication No. 11-141424 describes an intake manifold for a horizontally-opposed engine. The intake manifold has a manifold body formed by joining an upper molded part and a lower molded part, each of which is formed of plastic, to each other through means such as vibration welding.

Japanese Laid-Open Patent Publication No. 2005-61231 describes a structure having a manifold body and a flow regulating valve, which is separate from a manifold body and incorporated in a downstream end portion of the manifold body. The flow regulating valve is employed to control the intake air amount of the engine.

As described in Japanese Laid-Open Patent Publication No. 11-141424, when a valve casing of a flow regulating valve is joined to an end portion of a curved downstream section of a manifold body through vibration welding, the downstream end may warp outward with respect to the curved portion. In the configuration described in Japanese Laid-Open Patent Publication No. 2005-61231, the flow regulating valve is inserted into and fixed to the manifold body of the intake manifold using bolts or adhesive. In this case, the manifold body is overlapped with the casing of the flow regulating valve so that the thicknesses are added up. This does not contribute to reduction in weight of the vehicle.

Accordingly, it is an objective of the present invention to provide an intake manifold that not only reduces the weight of a vehicle employing the intake manifold but also makes it unlikely that a manifold body warps at the time when a valve casing is welded to the manifold body.

SUMMARY OF THE INVENTION

To achieve the foregoing objective and in accordance with one aspect of the present invention, an intake manifold is provided that includes a curved portion formed in a downstream section of a manifold body and a joining portion arranged in the curved portion. A valve casing of a flow regulating valve is joined to the joint portion. The intake manifold further includes an outer end and an inner end provided in the curved portion of the manifold body. The outer end is arranged at an outer tip end of the curved portion, and the inner end is arranged at an inner tip end of the curved portion. In addition, the intake manifold includes a height varying portion forming the joint portion such that an outer end of the curved portion is located at a position higher than an inner end of the curved portion.

In this intake manifold, the flow regulating valve is joined to an end portion of the manifold body. The thicknesses of the manifold body is overlapped with the casing of the flow regulating valve are not added up. As a result, the intake manifold contributes to reduction in weight of the vehicle. Also, warpage of the downstream end of the manifold body is made unlikely to happen by the height varying portion, which is formed in the joint portion between the manifold body and the valve casing. As a result, the intake manifold ensures highly accurate welding between the manifold body and the valve casing.

Accordingly, the above-described intake manifold decreases the weight of a vehicle employing the intake manifold and makes it unlikely that the manifold body warps.

DETAILED DESCRIPTION OF THE PREFERRED EMBODIMENTS

First Embodiment

An intake manifold for a horizontally-opposed four cylinder engine according to a first embodiment of the present invention will now be described with reference to the attached drawings. In the description below, the lateral direction in FIGS. 1 and 2 corresponds to the lateral direction of the intake manifold. The vertical direction in FIG. 2 corresponds to the forward-rearward direction of the intake manifold.

Figure 1:
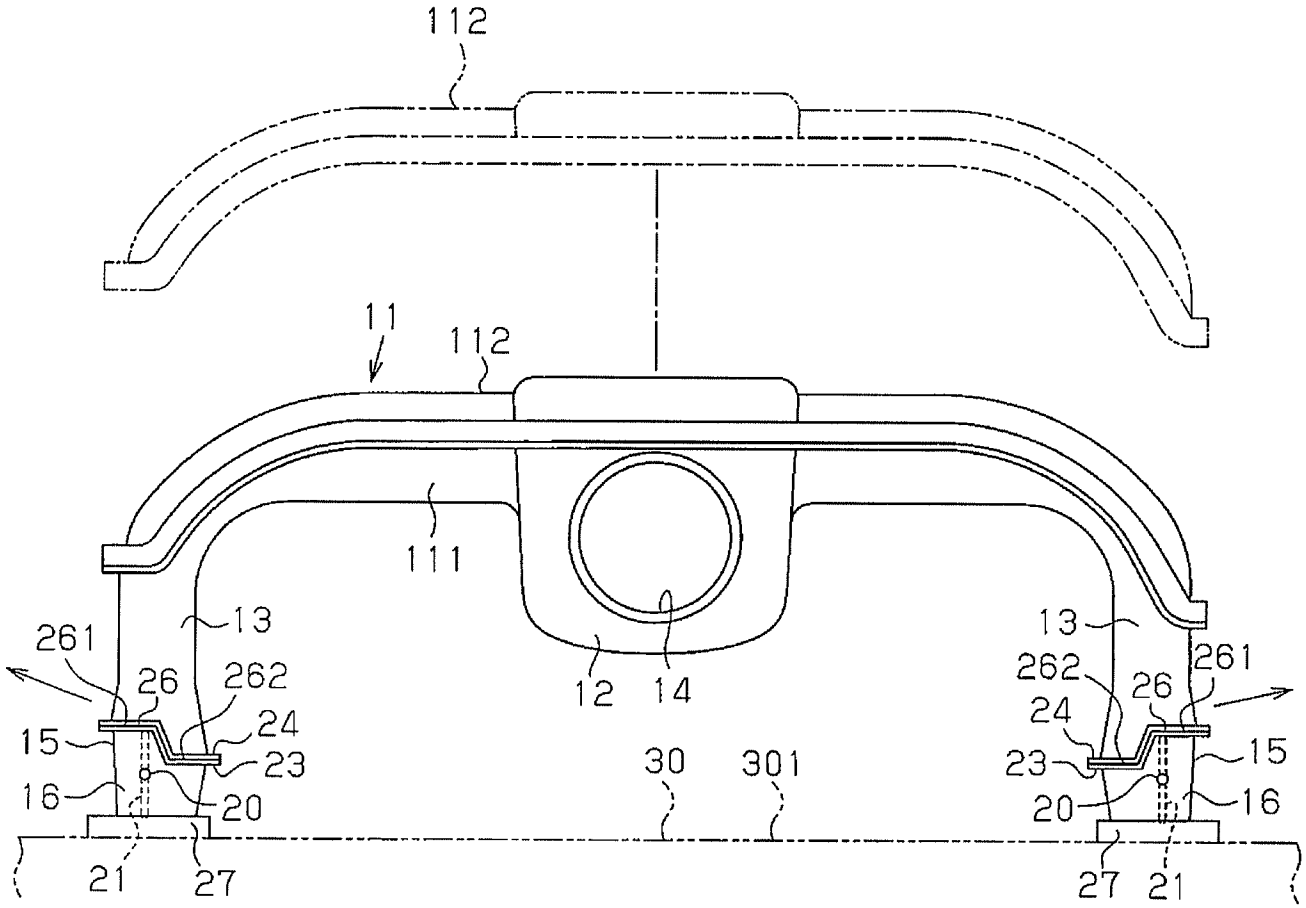
FIG. 1 is a front view showing an intake manifold according to a first embodiment of the present invention.
Figure 2:
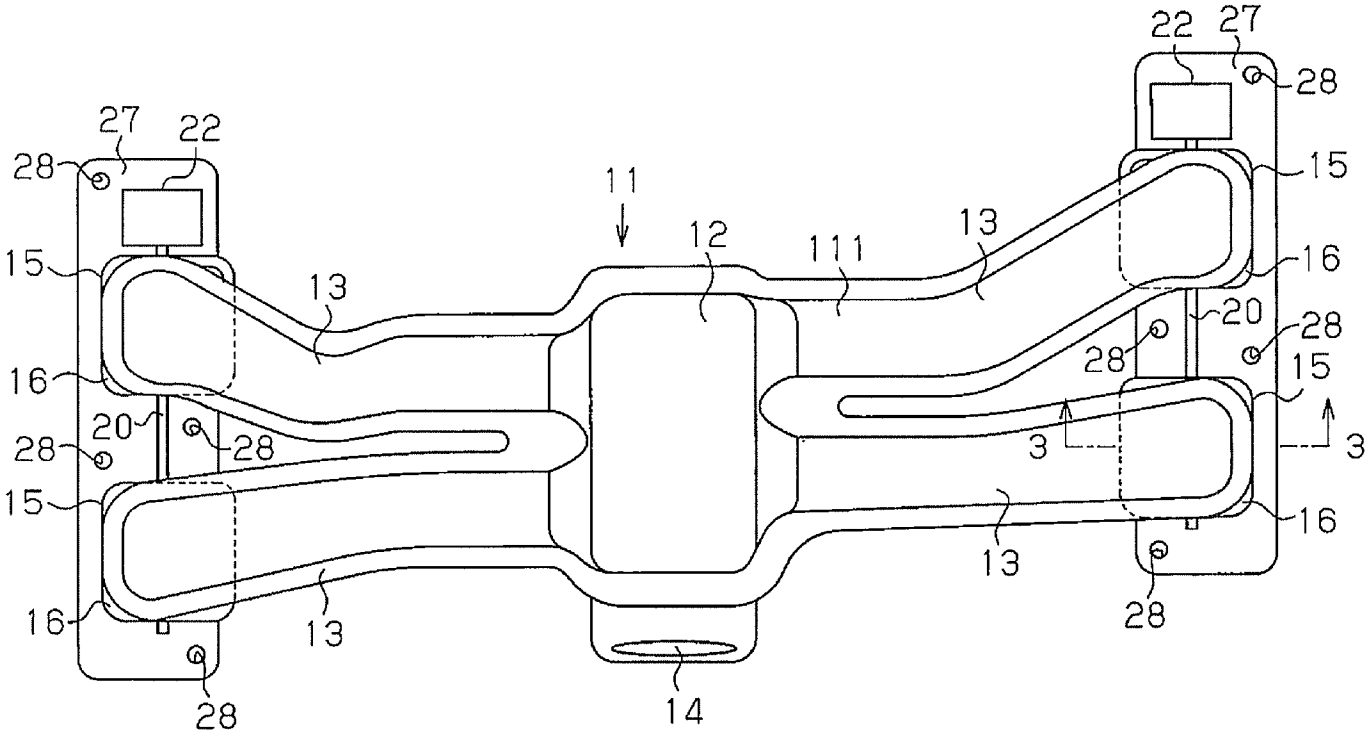
FIG. 2 is a plan view showing the intake manifold illustrated in FIG. 1.

As shown in FIGS. 1 and 2, a manifold body 11 of the intake manifold of the first embodiment as a whole is formed of heat-resistant plastic such as polyamide plastic. A surge tank 12 is arranged in a central portion of the manifold body 11. Two pairs of inlet pipes 13 project laterally from opposite lateral sides of the surge tank 12 such that two of the inlet pipes 13 are located on either side. A tip portion of each of the inlet pipes 13 is curved downward. Each one of the inlet pipes 13 is connected to a corresponding one of four combustion chambers, which are arranged in two pairs and formed in corresponding opposite banks of the horizontally-opposed four cylinder engine 30. In the case of a horizontally-opposed six cylinder engine, six inlet pipes 13 are employed and three of the inlet pipes 13 are arranged on either side.

With reference to FIGS. 1 and 2, an opening 14 for drawing air is formed in a front side of the surge tank 12. A non-illustrated air duct is connected to the opening 14 and sends air into the surge tank 12 after the air is filtered by a non-illustrated air cleaner. The air is then supplied from the surge tank 12 to each combustion chamber of the engine 30 through the corresponding inlet pipe 13.

As illustrated in FIG. 1, the manifold body 11 is configured by two separate parts, which are a lower split part 111 and an upper split part 112. The upper side of the lower split part 111 and the lower side of the upper split part 112 are open. The opening 14 of the surge tank 12 is formed in the front side of the lower split part 111. A lower portion of the upper split part 112 is joined and fixed to an upper portion of the lower split part 111 through vibration welding. In this manner, the surge tank 12 and the inlet pipes 13 are formed as an integral body.

Figure 3:
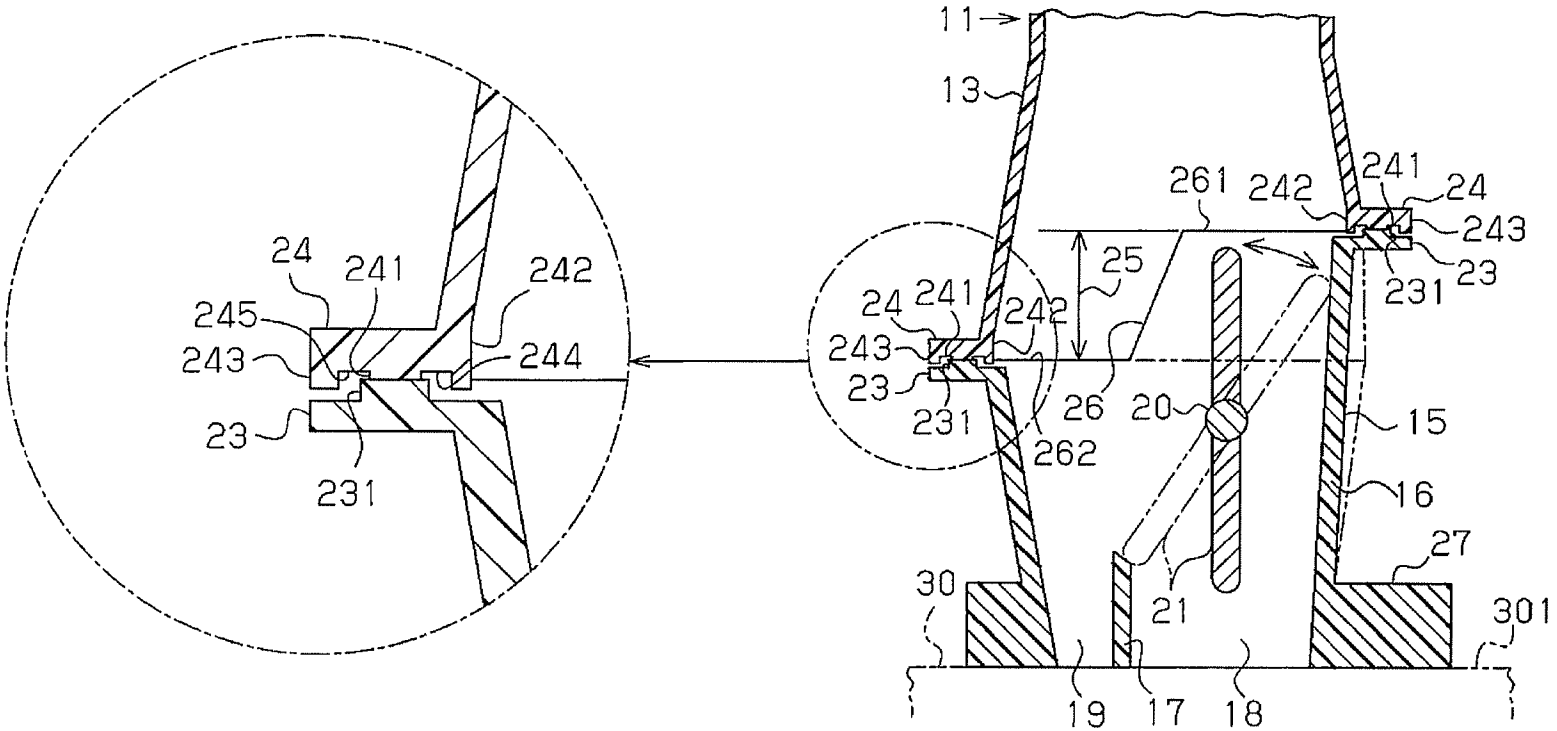
FIG. 3 is an enlarged cross-sectional view taken along line 3-3 of FIG. 2.

With reference to FIG. 3, a flow regulating valve 15 is installed in a downstream end of each of the inlet pipes 13 of the manifold body 11. Each of the flow regulating valves 15 includes a tubular valve casing 16 formed of heat-resistant plastic such as polyamide plastic, which is also used to form the manifold body 11. A partition wall 17 is formed in each of the valve casings 16. Each one of the partition walls 17 divides the interior of the associated one of the valve casings 16 into an outer first passage 18 and an inner second passage 19 in the lateral direction of the manifold body 11. In this case, the cross-sectional area of the first passage 18 is greater than the cross-sectional area of the second passage 19.

As illustrated in FIGS. 2 and 3, a valve shaft 20 is passed through and rotationally supported by the valve casings 16 of each pair of the flow regulating valves 15 that are adjacent to each other in the forward-rearward direction. A valve plate 21 serving as a valve body is fixed to the valve shaft 20 in the first passage 18 of each valve casing 16. An actuator 22 such as a motor is connected to each valve shaft 20 on the outer side of the rear one of the valve casings 16 on both right and left sides. Each one of the actuators 22 rotates the corresponding one of the valve shafts 20 to switch the associated one of the valve plates 21 selectively between the position for opening the first passage 18 and the position for closing the first passage 18, as represented by the solid lines and the broken lines in which a long dash alternates with a pair of short dashes in FIG. 3. This adjusts the flow amount of the air supplied into the combustion chambers of the engine 30 through the corresponding inlet pipes 13. Although not illustrated, a stopper is mounted inside or outside each valve casing 16 to retain the associated valve plate 21 at the aforementioned opening or closing position.

With reference to FIGS. 1 and 3, a downstream end of each inlet pipe 13 of the manifold body 11 has a shape widened toward the downstream end. In contrast, the valve casing 16 of each flow regulating valve 15 has a shape widened toward the upstream end and narrowed toward the downstream end. The widened shape of each inlet pipe 13 and the widened shape of each valve casing 16 maintain the effective cross-sectional areas of the passages 18, 19 in each valve casing 16 without being reduced by at least one of the valve shaft 20 and the valve plate 21. The shape of the valve casing 16 increases the air flow speed at the downstream opening of each flow regulating valve 15.

As illustrated in FIG. 3, a flange 23 projects from the outer edge of the upstream end of the valve casing 16. A protrusion 231 is formed on the top of the flange 23 and serves as a weld portion. A flange 24 corresponding to the flange 23 projects from the outer edge of the downstream end of each inlet pipe 13. A protrusion 241 serving as a weld portion projects from the lower side of the flange 24 and can be joined to the protrusion 231 of the valve casing 16. A rib 242 and a rib 243 project from the lower side of the flange 24 and are arranged radially inward and outward, respectively, to the protrusion 241 at positions spaced from the protrusion 241. A groove 244 is formed between the protrusion 241 and the rib 242 and a groove 245 is formed between the protrusion 241 and the rib 243.

After each valve casing 16 is arranged below the downstream end of the corresponding inlet pipe 13, the protrusion 231 of the valve casing 16 and the protrusion 241 of the downstream end of the inlet pipe 13, each of which serves as the weld portion at the downstream end, are joined to each other. In this state, at least one of the inlet pipe 13 and the valve casing 16 is vibrated to cause friction heat between the two protrusions 231, 241, which are used for welding, thus melting and fixing the protrusions 231, 241 to each other. In other words, the downstream end of each inlet pipe 13 and the upstream end of the corresponding valve casing 16 are fixed integrally through vibration welding at the protrusions 231, 241 each serving as the weld portion.

With reference to FIGS. 1 and 3, the joint portion between the inlet pipe 13 and the valve casing 16 includes a stepped surface 26 serving as a height varying portion, which causes a height difference 25. The first passage 18, which includes the valve plate 21, that is, the outer part of the curved portion of the inlet pipe 13 has an outer end located at the outer tip end. The inner part of the curved portion has an inner end located at the inner tip end. The height difference 25 is configured such that, in the valve casing 16, the outer end of the outer part is located at a higher position than the inner end of the inner part. In other words, a top portion 261 of the stepped surface 26, which is the outer end, is located on the opposite side to the surge tank 12 of the inlet pipe 13. A bottom portion 262 of the stepped surface 26, which is the inner end, is arranged on the side closer to the surge tank 12. In an upright state in which the valve plate 21 opens the first passage 18, the upper end of the valve plate 21 is located at a position lower than the upper end of the valve casing 16.

As illustrated in FIGS. 1 to 3, on either lateral side of the engine, an attachment seat 27 connects the downstream ends of the valve casings 16 of the flow regulating valves 15, which are adjacent to each other in the forward-rearward direction. Each of the attachment seats 27 is formed integrally with the corresponding pair of the valve casings 16. Each attachment seat 27 has a plurality of attachment holes 28 for fixing the intake manifold as a whole to a cylinder block 301 of the engine 30 using non-illustrated bolts.

Operation of the intake manifold, which is configured in the above-described manner, will hereafter be described.

When the engine 30 is running, the air filtered by the air cleaner is supplied from the air cleaner to the surge tank 12 and then delivered to the combustion chambers of the engine 30 through the inlet pipes 13. If the engine 30 is in low-speed operation, the valve plate 21 of each flow regulating valve 15 closes the first passage 18 so that a comparatively small amount of air is drawn to the engine 30 through the second passage 19. When the engine 30 is in high-speed operation, the valve plate 21 of the flow regulating valve 15 opens the first passage 18 so that a comparatively great amount of air is drawn to the engine 30 through the first and second passages 18, 19. As a result, the air is delivered to the engine 30 by an amount suitable for the engine speed. Also, since the valve casing 16 of each flow regulating valve 15 has a shape narrowed toward the downstream end, the flow velocity of the air in the first and second passages 18, 19 is increased toward the downstream end of the valve casing 16 when the air is supplied to the engine 30. This ensures a sufficiently high speed of swirl or tumble in each combustion chamber. As a result, the engine 30 operates highly efficiently.

The valve casing 16 of each flow regulating valve 15 must have the shape widened toward the upstream end and narrowed toward the downstream end not only to promote highly efficient engine operation, but also to facilitate removal of the valve casing 16 from the die for molding the valve casing 16. If the joint portion between the valve casing 16 and the inlet pipe 13 is shaped linearly and arranged in the vicinity of the valve shaft 20 without providing the height difference 25 as represented by the broken lines in which a long dash alternates with a pair of short dashes in FIG. 3, the distance between the opposite end openings of the valve casing 16 in the vertical direction decreases and the inclination angle of the side wall of the valve casing 16 becomes acute, thus increasing the change amount of the effective cross-sectional area of each passage in the valve casing 16. This generates a turbulent air stream in the valve casing 16, which is undesirable for highly efficient engine operation. If the joint portion is shaped linearly and arranged at a position spaced upward from the valve shaft 20, the size of the valve casing 16 increases and the valve casing 16 becomes difficult to handle when being manufactured, for example.

In contrast, according to the first embodiment, the height difference 25 is provided in the joint portion between the inlet pipe 13 and the valve casing 16 such that a substantially half the joint portion is spaced upward from the valve shaft 20. This decreases the change amount of the effective cross-sectional area of the passage in the valve casing 16, thus ensuring efficient engine operation. The other half of the joint portion is arranged in the vicinity of the valve shaft 20 so that the valve casing 16 becomes compact. This facilitates handling of the valve casing 16 when the valve casing 16 is manufactured.

Before performing vibration welding on the valve casings 16 and the inlet pipes 13, the manifold body 11 and the valve casings 16 are held in a contacting state and set on a non-illustrated jig. In this state, vibration is applied to the manifold body 11 and/or the valve casings 16. At this stage, the applied vibration and the contacting pressure between the manifold body 11 and the valve casings 16 may cause the outer parts of the curved portions to warp in the directions represented by the arrows in FIG. 1, or, in other words, outward at the downstream ends of the inlet pipes 13. However, such warpage of the inlet pipes 13 is made unlikely to happen by the height difference 25 formed in the joint portion between each inlet pipe 13 and the corresponding valve casing 16, by which the side spaced from the surge tank 12 is located at a position higher than the side close to the surge tank 12. As a result, each inlet pipe 13 of the manifold body 11 and the corresponding valve casing 16 are welded together with high accuracy.

The first embodiment has the advantages described below.

(1) In the intake manifold of the first embodiment, the valve casing 16 of each flow regulating valve 15 is welded to the downstream end of the manifold body 11. The joint portion between the manifold body 11 and the valve casing 16 has the height difference 25 such that the side spaced from the surge tank 12, which is the outer part of the curved portion, is located at a position higher than the inner part of the curved portion.

The height difference 25 makes it unlikely that the downstream end of the manifold body 11 warps when such warpage may be induced. The manifold body 11 and the valve casing 16 are thus welded together with improved accuracy.

(2) In the intake manifold of the first embodiment, the joint portion between the manifold body 11 and each valve casing 16 has the height difference 25, by which the outer part of the curved portion of the inlet pipe 13 is located comparatively high. This reduces the change amount of the effective cross-sectional areas of the passages 18, 19 in the valve casing 16 despite the fact that the downstream end of the manifold body 11 and the valve casing 16 of the flow regulating valve 15 are shaped to enlarge toward the joint portion. This promotes highly efficient engine operation and prevents the components from being increased in size.

(3) In the intake manifold of the first embodiment, the stepped surface 26 is formed in the joint portion between the manifold body 11 and each valve casing 16 to provide the height difference 25. This ensures the above-described advantages of the first embodiment without increasing the number of the necessary components or complicating the configuration.

(4) In the intake manifold of the first embodiment, the valve casing 16 of each flow regulating valve 15 is joined to the downstream end of the corresponding inlet pipe 13 without being inserted into the inlet pipe 13. The thicknesses of the downstream end of the inlet pipe 13 and the valve casing 16 are thus not added up. The intake manifold thus contributes to reduction weight of the vehicle.

Second Embodiment

An intake manifold according to a second embodiment of the present invention will hereafter be described. The description below is focused on the difference between the first embodiment and the second embodiment.

Figure 4:
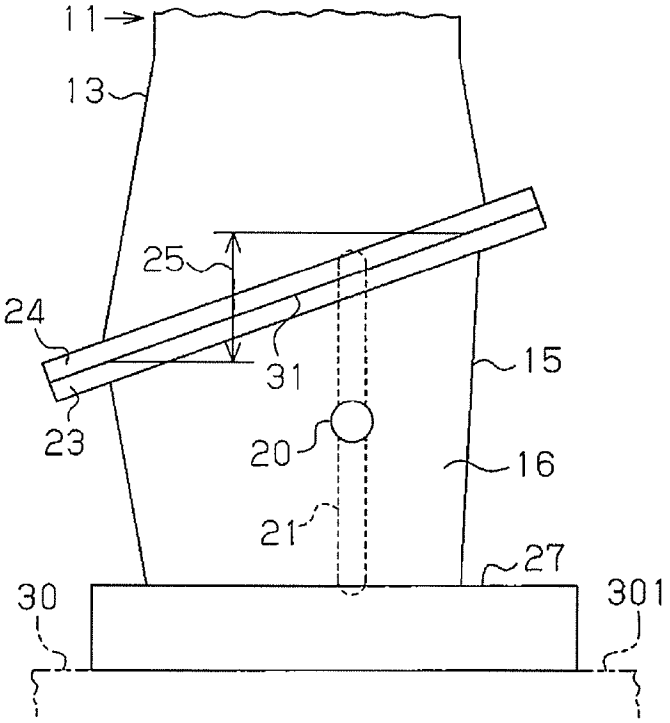
FIG. 4 is a front view showing a portion of an intake manifold according to a second embodiment of the invention.

In the second embodiment, as illustrated in FIG. 4, the height difference 25 is provided by an inclined surface 31. The inclined surface 31 is formed in the joint portion between the downstream end of each inlet pipe 13 of the manifold body 11 and the valve casing 16 of the corresponding flow regulating valve 15 such that the outer part of the curved portion is higher than the inner part of the curved portion.

Accordingly, the second embodiment has substantially the same advantages as the advantages (1) to (4) of the first embodiment.

MODIFICATIONS

The illustrated embodiments may be modified to the forms described below.

The present invention may be used in an intake manifold employed in a V engine such as a six-cylinder V engine or an inline engine such as a four-cylinder inline engine. In the intake manifold of a V engine, a plurality of inlet pipes and a plurality of flow regulating valves are arranged in groups on the opposite sides corresponding to the two banks of the engine, as in the case of the intake manifold of the illustrated embodiments. However, the manifold body of the intake manifold of the V engine is shaped differently from the manifold body of the intake manifold of the illustrated embodiments. The intake manifold body is shaped in correspondence with at least one of the bank angle and the engine mounting position. In the intake manifold of an inline engine, a plurality of inlet pipes and a plurality of flow regulating valves are mounted in a state aligned in correspondence with only one side of the cylinder head.

Figure 5:
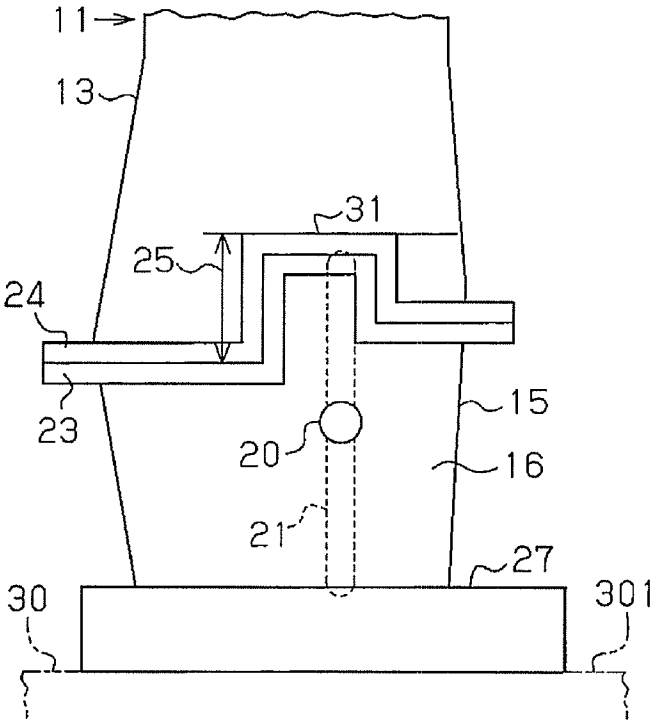
FIG. 5 is a front view showing a portion of an intake manifold according to another embodiment of the invention.

As shown in FIG. 5, the stepped surface 26 may be shaped with a projection such that comparatively low portions of the stepped surface 26 are arranged on the opposite sides of the projection of the stepped surface 26. Alternatively, although not illustrated, the stepped surface 26 may have a zigzag shape.

Three or more passages may be formed in the valve casing 16 of each flow regulating valve 15.

The manifold body 11 and the valve casing 16 may be fixed to each other using adhesive. When the manifold body 11 is pressed against and joined to the valve casing 16 with adhesive, the inlet pipe 13 may deform in a radially spreading manner. However, such radial spread of the inlet pipe 13 is suppressed by the height difference 25.

The invention claimed is:

1. An intake manifold having a curved portion formed in a downstream section of a manifold body and a joint portion arranged in the curved portion, wherein a valve casing of a flow regulating valve is joined to the joint portion, the intake manifold comprising:

an outer end and an inner end provided in the curved portion of the manifold body, wherein the outer end is arranged at an outer tip end of the curved portion, and the inner end is arranged at an inner tip end of the curved portion; and a height varying portion forming the joint portion, the height varying portion comprising a stepped joint surface, such that the outer end of the curved portion is located at a position higher than the inner end of the curved portion.

2. The intake manifold according to claim 1, wherein the valve casing of the flow regulating valve includes at least two passages formed in the valve casing, and the intake manifold further comprises a valve body that selectively switches at least one of the passages between an open state and a closed state.

3. The intake manifold according to claim 1, wherein the manifold body and the valve casing are widened toward the joint portion.

4. The intake manifold according to claim 1, wherein the manifold body and the valve casing are welded to each other at the joint portion.

5. The intake manifold according to claim 1, wherein the manifold body is configured by a surge tank and inlet pipes projecting from opposite sides of the surge tank.

* * * * *